US008661989B2

(12) United States Patent
Tsai et al.

(10) Patent No.: US 8,661,989 B2
(45) Date of Patent: Mar. 4, 2014

(54) ADJUSTABLE DESK

(75) Inventors: Chi-Cheng Tsai, Nantou (TW); Te-Ju Hsieh, Nantou (TW)

(73) Assignee: Sing-Bee Enterprise Co., Ltd., Nantou, Nantou County (TW)

( * ) Notice: Subject to any disclaimer, the term of this patent is extended or adjusted under 35 U.S.C. 154(b) by 154 days.

(21) Appl. No.: 13/338,878

(22) Filed: Dec. 28, 2011

(65) Prior Publication Data

US 2013/0167757 A1 Jul. 4, 2013

(51) Int. Cl.
*A47F 5/12* (2006.01)

(52) U.S. Cl.
USPC ..... 108/10; 108/9; 108/145; 108/147

(58) Field of Classification Search
USPC ..... 108/3, 6–10, 145, 147, 50.02, 20
See application file for complete search history.

(56) References Cited

U.S. PATENT DOCUMENTS

| | | | | | |
|---|---|---|---|---|---|
| 4,131,801 | A * | 12/1978 | Hogan | 5/601 |
| 4,539,913 | A * | 9/1985 | Marchant | 108/7 |
| 4,637,322 | A * | 1/1987 | Hampshire et al. | 108/102 |
| 4,725,106 | A * | 2/1988 | Shields et al. | 312/223.3 |
| 4,856,129 | A * | 8/1989 | Butler | 5/610 |
| 5,138,955 | A * | 8/1992 | Manner | 108/1 |
| 5,549,053 | A * | 8/1996 | Grout | 108/147 |
| 5,720,591 | A * | 2/1998 | Ledet | 414/778 |
| 7,171,909 | B2 * | 2/2007 | Alt | 108/7 |
| 7,594,475 | B1 | 9/2009 | Huang | |
| 2005/0101396 | A1 * | 5/2005 | Chevillotte | 473/4 |
| 2006/0065163 | A1 * | 3/2006 | Chi et al. | 108/7 |
| 2008/0017080 | A1 * | 1/2008 | Wang | 108/6 |
| 2008/0028996 | A1 * | 2/2008 | Ooba et al. | 108/10 |
| 2010/0050843 | A1 * | 3/2010 | Gass et al. | 83/477.1 |
| 2010/0175592 | A1 * | 7/2010 | Looser | 108/2 |
| 2011/0168062 | A1 * | 7/2011 | Dellavecchia | 108/7 |

FOREIGN PATENT DOCUMENTS

| | | | | |
|---|---|---|---|---|
| GB | 2214069 | A * | 8/1989 | A47B 9/00 |

* cited by examiner

*Primary Examiner* — Hanh V Tran

(74) *Attorney, Agent, or Firm* — Muncy, Geissler, Olds & Lowe, P.C.

(57) ABSTRACT

An adjustable desk includes a desk board, a supporting unit, and a first adjusting unit. The desk board includes front and rear ends. The supporting unit disposed between the desk board and the ground includes a first leg pivotally connected with the front end. The first adjusting unit mounted between the desk board and the first leg includes a screw shaft, at least one linkage, and at least one level. The linkage is engaged screwedly with screw shaft. The level pivotally connected between the linkage and the rear end. While the screw shaft is rotated, the linkage is moved axially between two ends of the outer screw portions to drive the level pivoting with respect to the screw shaft. The desk board is pivoted with respect to the first leg to adjust a slope angle formed between the desk board and the supporting unit steplessly without tools.

14 Claims, 11 Drawing Sheets

ADJUSTABLE DESK

BACKGROUND OF THE INVENTION

1. Field of the Invention

The present invention relates to a desk, in particular, to a desk including a desktop adjustable to various tilting positions and various heights.

2. Description of the Related Art

Typically, the conventional desk commonly consists of a desk board and a plurality of side legs secured to the desk board; however, those fixed legs render the desk board unable to be adjusted to the desire height and slope levels and incurs some problems. For instance, the desk may not be suitable for all pupils or adults due to the restriction on the settled height or slope of the desk, which hence results of the using inconvenience or even affects users' postures.

In this manner, desks with adjustable design are produced to improve the deficiencies of the conventional desk. U.S. Pat. No. 7,594,475 discloses an adjustable desk having a desk board and two supporting legs. Each supporting leg includes an upper frame, a lower frame, and fasteners. Both upper frames and lower frames have respective slots, which intersect to form dual intersections for allowing fasteners to penetrate between the intersections, to slide within the two slots, and to position the upper frame with the lower frame. Raising or tilting the desk board to the desired height and slopped position is achieved via tightening or loosening the fasteners; the supporting leg has an adjustable apparatus disposed thereon for users to hold onto.

However, a problem with the adjustable desk is that tightening or loosening the fasteners to raise or tilt the desk is inconvenience and wastes time, and must use tools.

The present invention is, therefore, intended to obviate or at least alleviate the problems encountered in the prior art.

SUMMARY OF THE INVENTION

According to the present invention, an adjustable desk includes a desk board, a supporting unit, and a first adjusting unit. The desk board includes front and rear ends. The supporting unit disposed between the desk board and the ground includes a first leg pivotally connected with the front end. The first adjusting unit mounted between the desk board and the first leg includes a screw shaft, at least one linkage, and at least one level. The linkage is engaged screwedly with screw shaft. The level pivotally connected between the linkage and the rear end. While the screw shaft is rotated, the linkage is moved axially between two ends of the outer screw portions to drive the level pivoting with respect to the screw shaft. The desk board is pivoted with respect to the first leg to adjust a slope angle formed between the desk board and the supporting unit steplessly without tools.

It is an objective of the present invention to provide an adjustable desk is adjustable slope angle of its desktop and height steplessly.

It is another objective of the present invention to provide an adjustable desk is adjustable without tools.

Other objectives, advantages, and novel features of the invention will become more apparent from the following detailed description when taken in conjunction with the accompanying drawings.

BRIEF DESCRIPTION OF THE DRAWINGS

For the present disclosure to be easily understood and readily practiced, the present disclosure will now be described for the purpose of illustration not limitation, in conjunction with the following figures, wherein.

Figure 1:
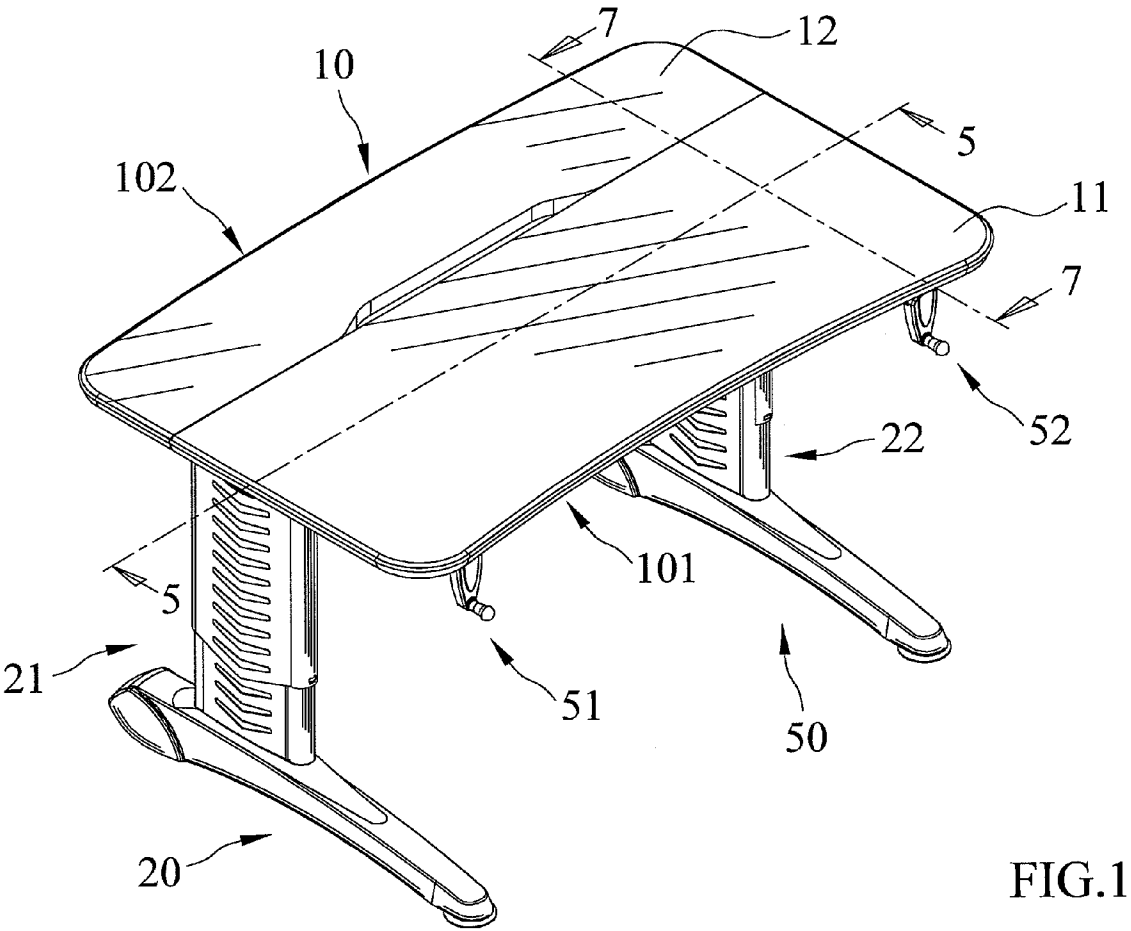
FIG. 1 is a perspective view of an adjustable desk in accordance with the present invention.
Figure 2:
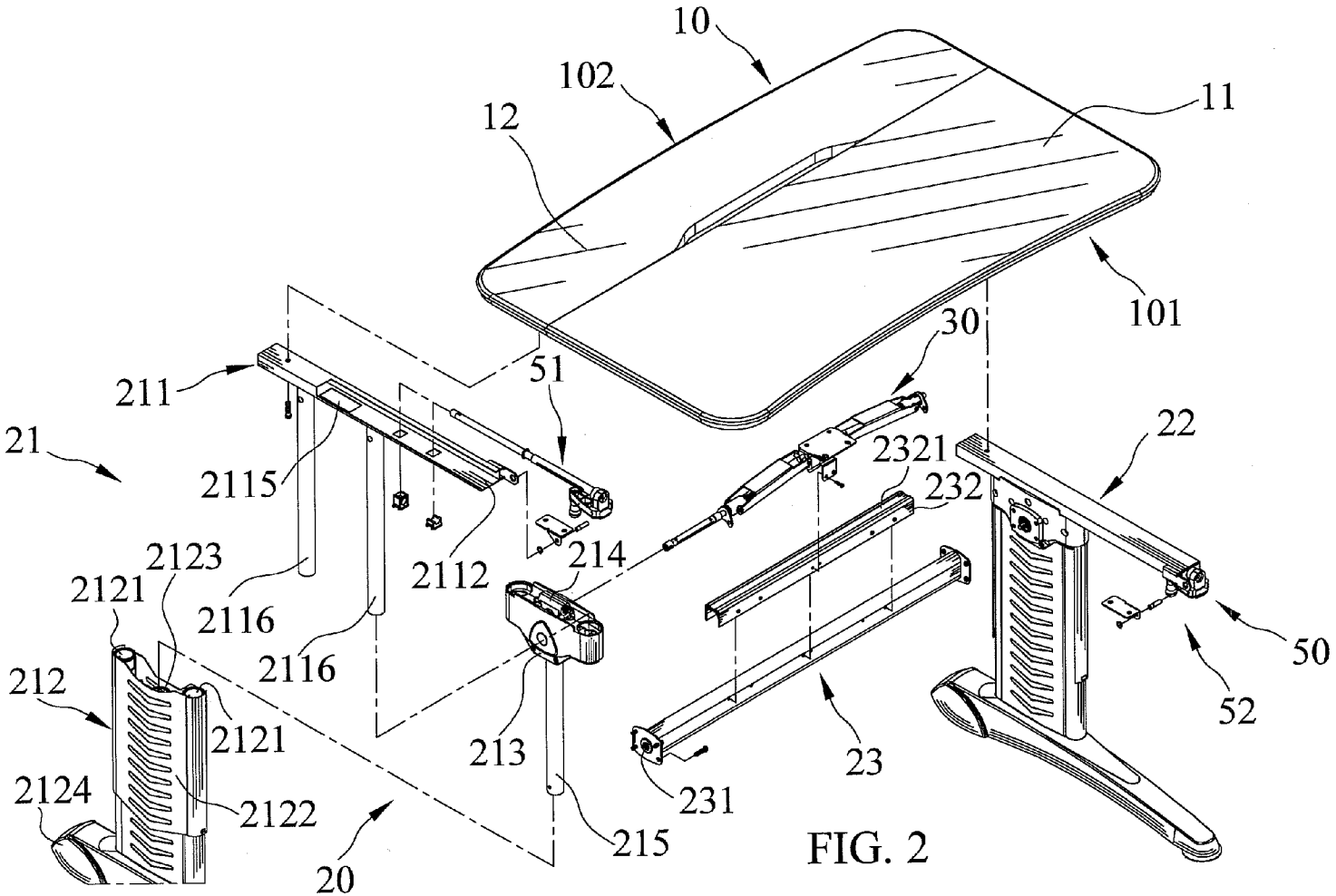
FIG. 2 is a partial, exploded perspective view of FIG. 1.
Figure 3:
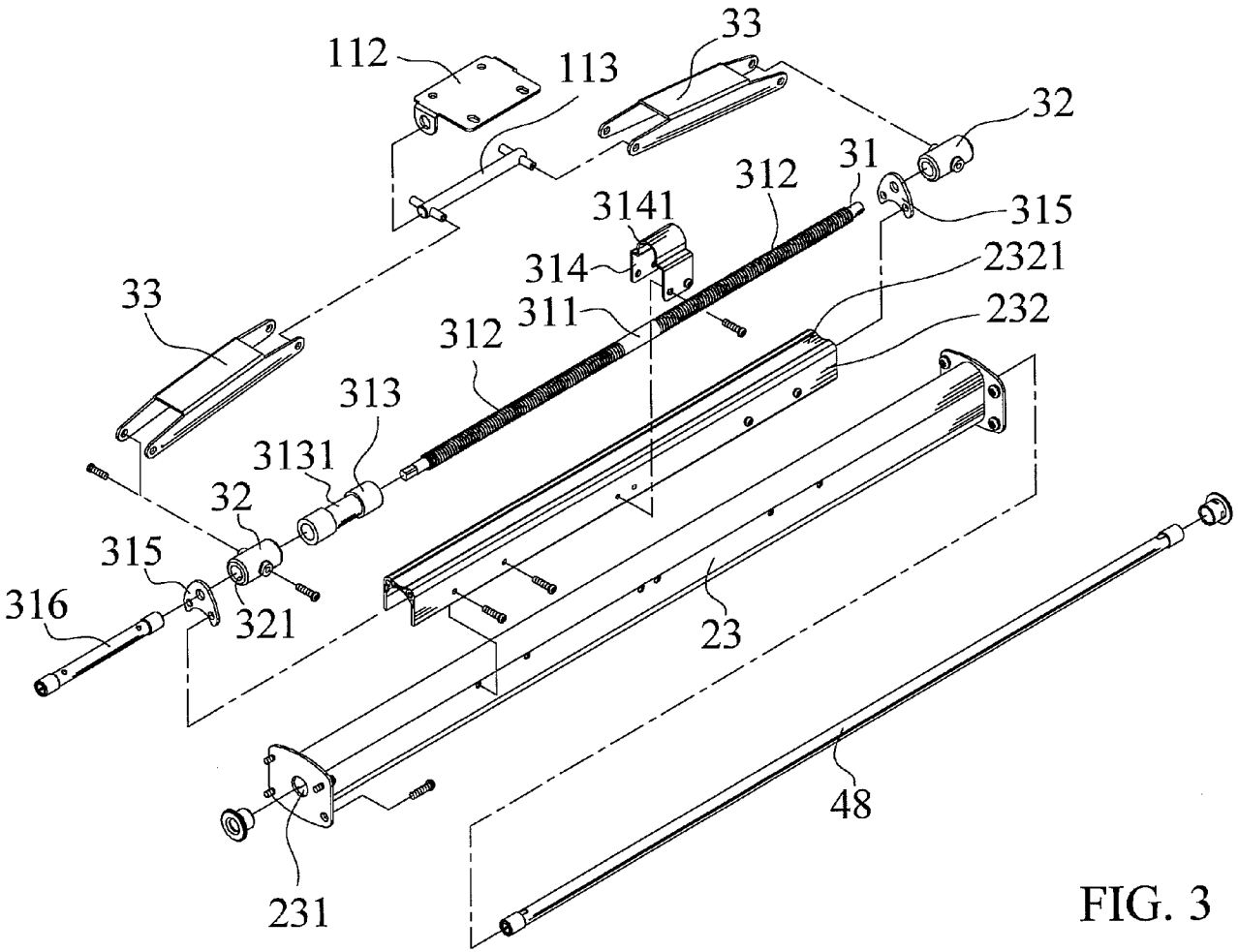
FIG. 3 is a partial, enlarged view of FIG. 2.
Figure 4:
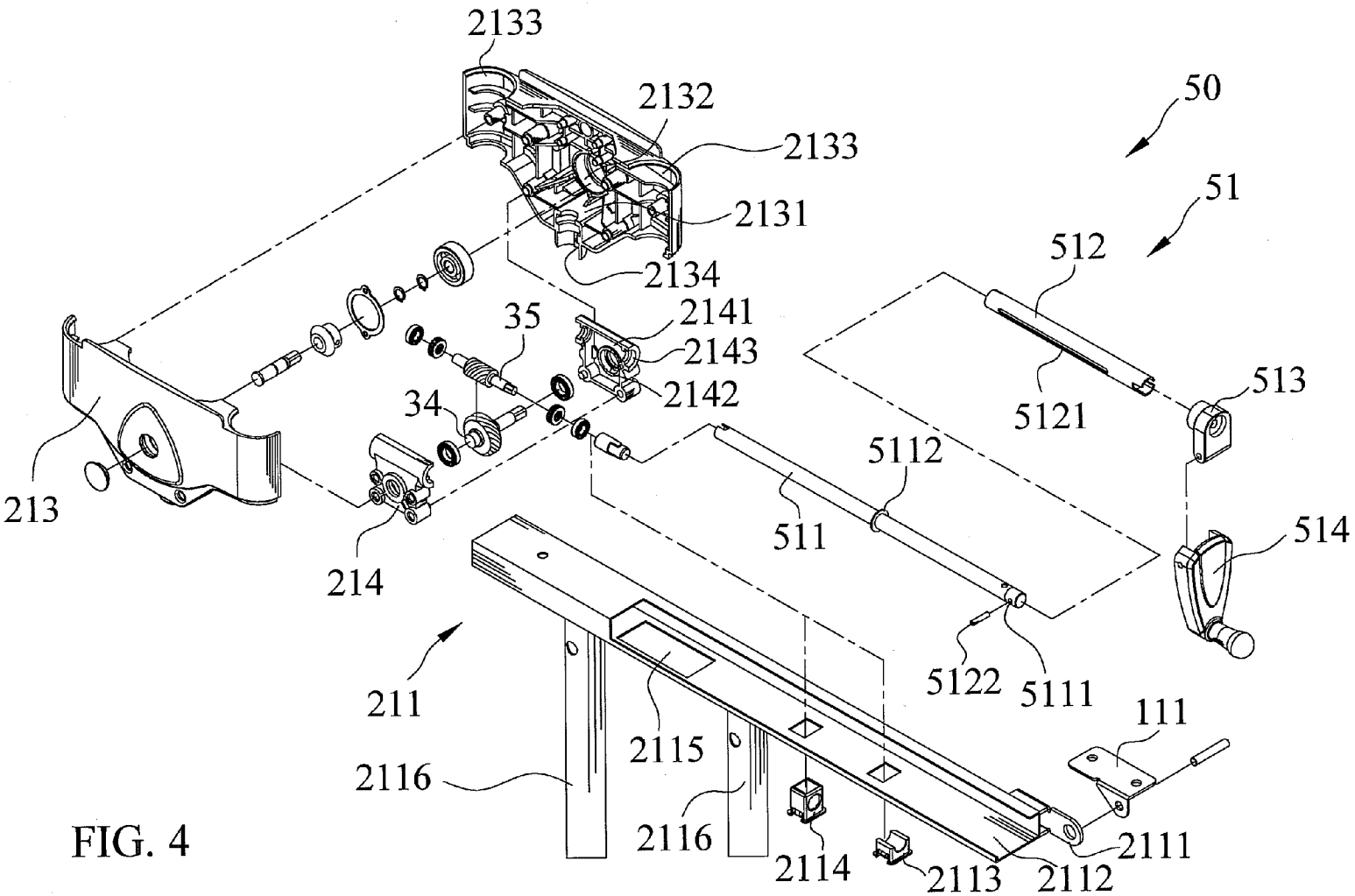
FIG. 4 is an exploded perspective view similar to FIG. 2, except taken from a different angle of view.
Figure 5:
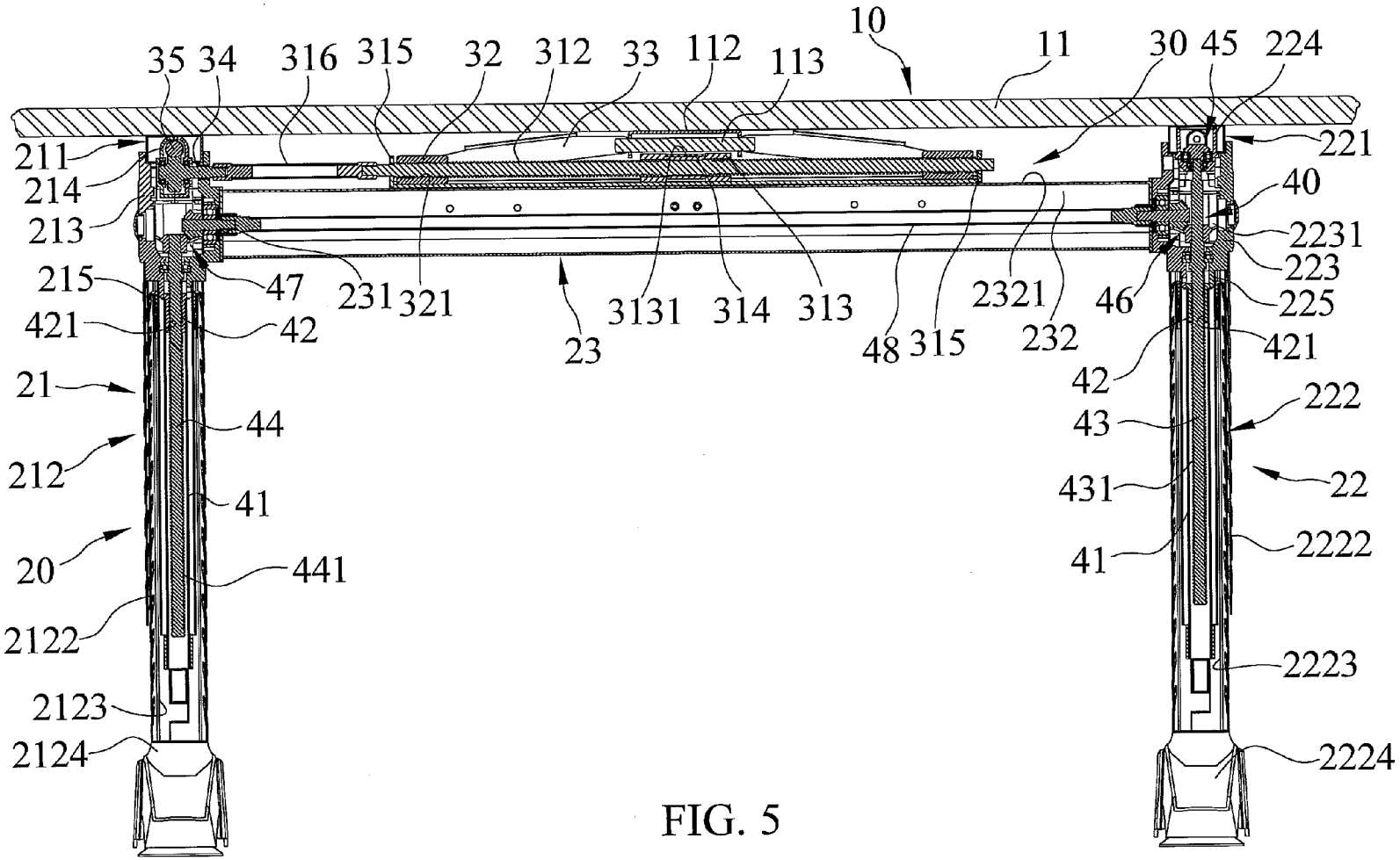
FIG. 5 is a cross-sectional view taken along line 5-5 of FIG. 1.
Figure 6:
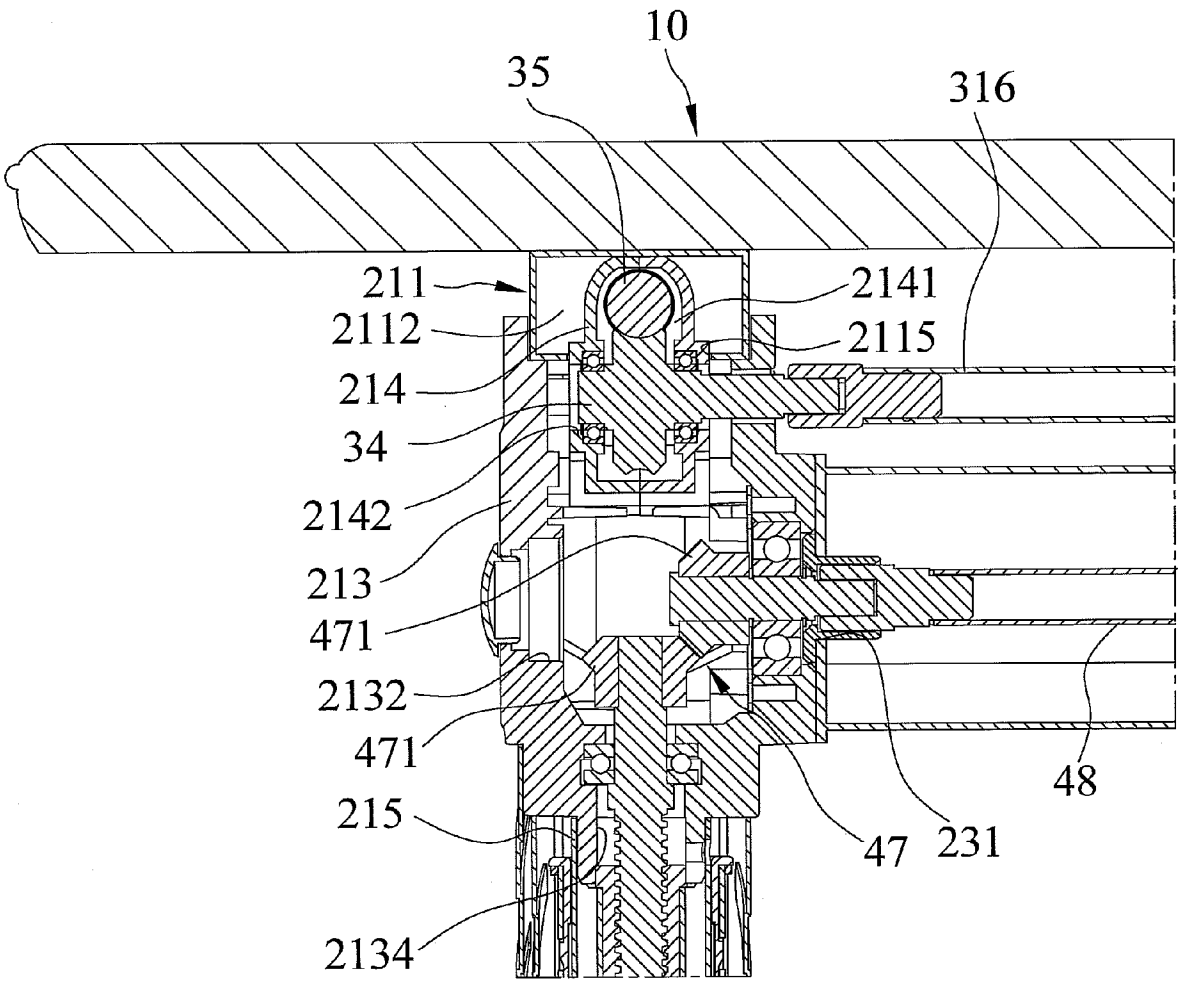
FIG. 6 is a partial, enlarged of FIG. 5.
Figure 7:
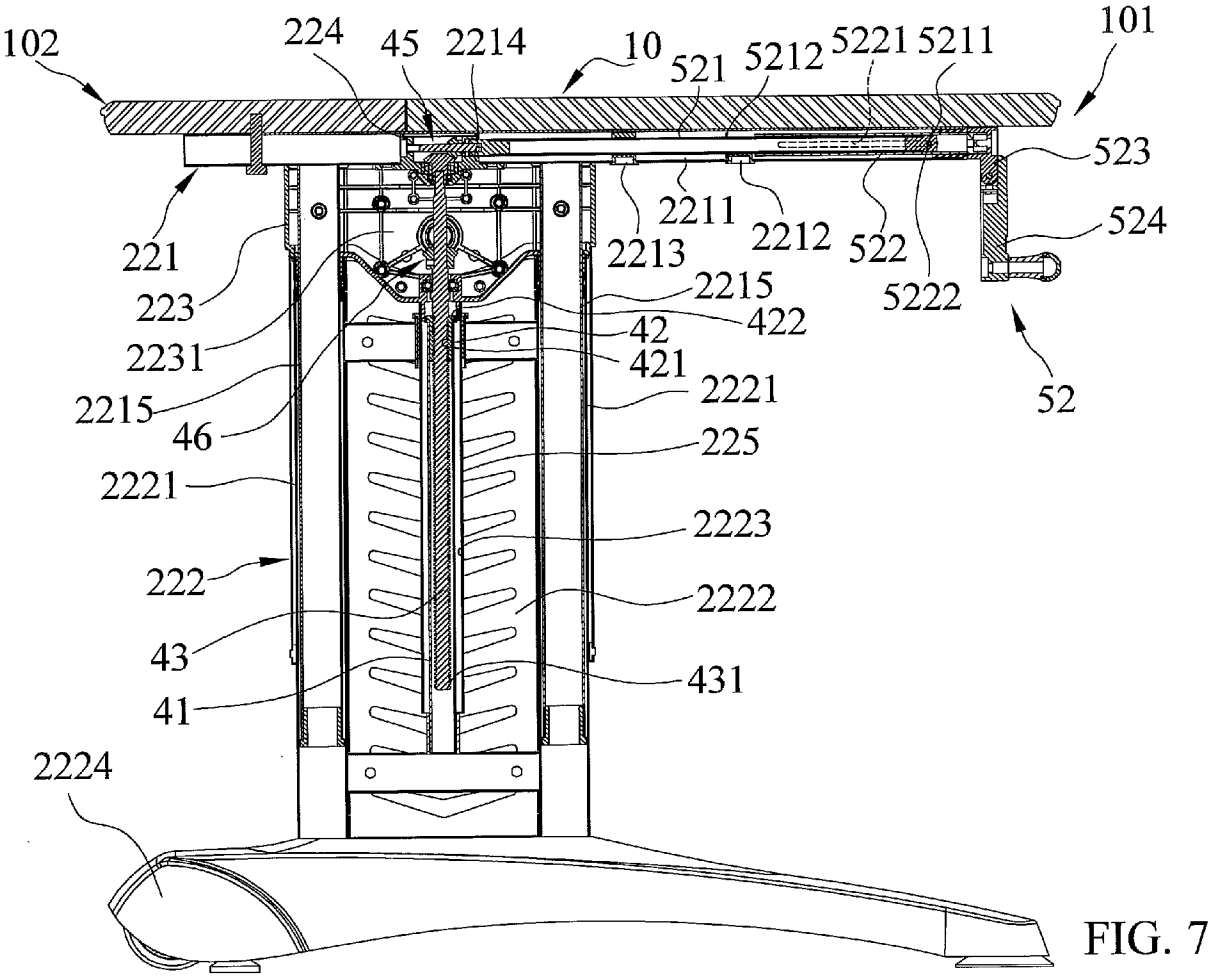
FIG. 7 is a cross-sectional view taken along line 7-7 of FIG. 1.
Figure 8:
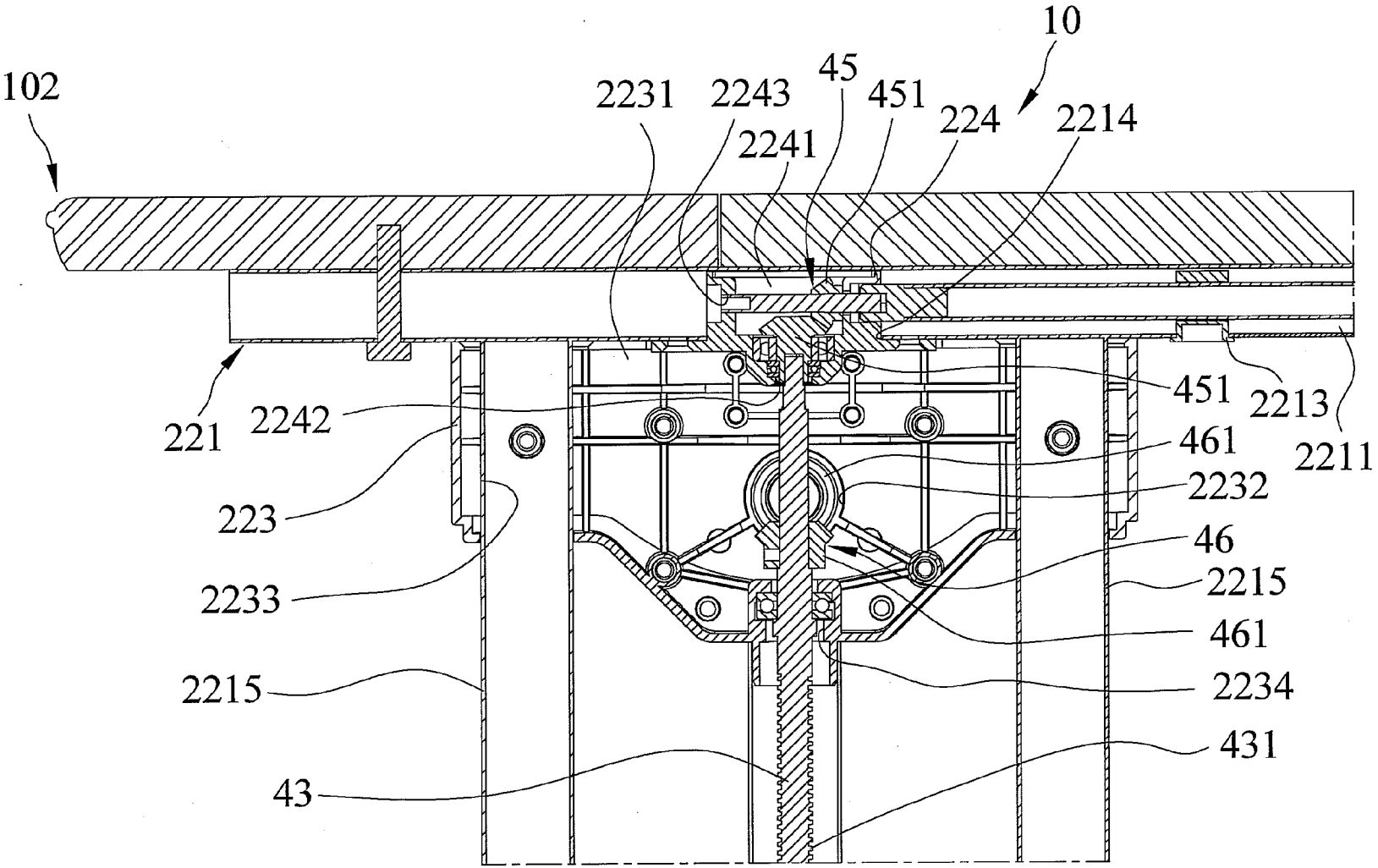
FIG. 8 is a partial, enlarged view of FIG. 7.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

Referring to FIGS. 1 through 8, an adjustable desk in accordance with the present invention includes a desk board 10, a supporting unit 20, a first adjusting unit 30, a second adjusting unit 40, and a control unit 50. The first adjusting unit 30 mounted between the desk board 10 and the supporting unit 20 provides to adjust the slope of the desk board 10. The second adjusting unit 40 mounted in the supporting unit 20 provides to adjust the height between the desk board 10 and ground. The control unit 50 connects with the first and second adjusting units 30 and 40.

The desk board 10 defines front and rear ends 101 and 102, and includes first and second panels 11 and 12. The first panel 11 includes an L-shaped lug 111 disposed adjacent to the front end 101 and a U-shaped seat 112 disposed adjacent to the rear end 102. The seat 112 mounts an I-shaped stem 113 connected between two sides thereof. At least one end of the stein 113 is pivotally connected with the first adjusting unit 30. The second panel 12 is connected with the supporting unit 20.

The supporting unit 20 includes first and second legs 21 and 22 mounted on a bottom of the desk board 10, and a beam 23 connecting between first and second legs 21 and 22. The first leg 21 includes first upper and first lower holders 211 and 212, a first box 213, a first case 214, and a first inner tube 215. The first upper holder 211 is connected with the desk board 10 and includes a first rest 2111, a first trough 2112, first outer and first inner axle seats 2113 and 2114, a first slot 2115, and two first guide posts 2116. The first rest 2111 is pivotally connected with the lug 111. The first trough 2112 is extended from the front end 101 to the rear end 102 of the desk board 10. The outer and inner axle seats 2113 and 2114 are mounted on a bottom of the first trough 2112 to provide supporting the control unit 50. The two first guide posts 2116 are extended longitudinally towards the first lower holder 212. The first lower holder 212 includes two first outer tubes 2121, a first side cover 2122, a first through hole 2123, and a first supporting portion 2124. The two first outer tubes 2121 are slidably and movably connected with the two first guide posts 2116, respectively. The first side cover 2122 connects between the two first outer tubes 2121. The first through hole 2123 is disposed parallel to the first side cover 2122 longitudinally and vertical to the first supporting portion 2124. The first supporting portion 2124 provides the adjustable desk securely standing on the ground. The first box 213 is mounted between the first upper and first lower holders 211 and 212 and includes a first receiving portion 2131, a first bore 2132, two first guide grooves 2133, and a first aperture 2134. The first receiving portion 2131, the first bore 2132, and the first aperture 2134 connect and communicate with each other. The two first guide grooves 2133 respectively receive the two first guide posts 2116. The first case 214 is mounted on the first box 213 and protrudes out the first trough 2112 via the first slot 2115. The first case 214 is hollow inside and includes a first channel 2141, a first orifice 2142, and a first cavity 2143, which connect and communicate with each other. The first orifice 2142 is extended crossing with the first cavity 2143 and parallel to the first bore 2132. The first inner tube 215 is mounted on the first box 213 and received in the first through hole 2123, so that the first box 213 is capable of moving slidably with respect to the first lower holder 212. The beam 23 is mounted between the first and second legs 21 and 22 and includes a pore 231, and a bench 232 mounted on a top thereof. The bench 232 has a pit 2321.

The first adjusting unit 30 includes a screw shaft 31, at least one linkage 32, at least one level 33, a worm gear 34, a worm shaft 35. The embodiment includes two linkages 32 and two levels 33. The screw shaft 31 includes a central portion 311, two outer screw portions 312, a socket 313, a fixture 314, two braces 315, and an extending rod 316. The two outer screw portions 312 are respectively extended from two opposite ends of the central portion 311 to the two distal ends of the screw shaft 31. The socket 313 receives and completely covers the central portion 311, and includes a ditch 3131 formed around a periphery thereof. The fixture 314 formed in a U shape is connected with the bench 232 and includes a buckling portion 3141 abutted against the ditch 3131. The screw shaft 31 is disposed rotatably between the buckling portion 3141 and the pit 2321, and the fixture 314 restricts that the screw shaft 31 cannot depart from the bench 232. The two braces 315 are respectively jointed with the two distal ends of the screw shaft 31 and mounted on two ends of the bench 232. The two braces 315 limit the two linkages 32 cannot depart from the screw shaft 31. Two ends of the extending rod 316 are respectively connected with the screw shaft 31 and the worm gear 34, so that the worm gear 34 is able to drive the screw shaft 31 rotating with respect to the pit 2321. Each linkage 32 includes an inner screw portion 321 engaged with the outer screw portions 312 whereby while the screw shaft 31 is rotated, each linkage 32 is able to be moved axially between the two opposite ends of the each outer screw portions 312. The socket 313 and the braces 315 provide the linkage 32 cannot disengage with the outer screw portions 312. The levels 33 are pivotally connected between the linkage 32 and the stem 113. While each linkage 32 is moved axially with respect to each outer screw portions 312, the linkage 32 drives the level 33 to pivot with respect to the linkage 32 and the stem 113, whereby a height defined between the desk board 10 and the screw shaft 31 is adjusted. An extending axis of the worm gear 34 is parallel to the screw shaft 31. An extending axis of the worm shaft 35 is vertical to the screw shaft 31. The worm gear 34 and the worm shaft 35 are rotatably received in the first channel 2141. The worm gear 34 protrudes out the first case 214 via the first orifice 2142 and connects with the extending rod 316. The worm shaft 35 extends through the first cavity 2143 and is engaged with the worm gear 34.

The control unit 50 includes a first control assembly 51 mounted on the first leg 21 and a second control assembly 52 mounted on the second leg 22. The first control assembly 51 includes a first control bar 511, a first expansion bar 512, a first lid 513, and a first shank 514. Moreover, the structure of the second control assembly 52 is similar to the first control assembly 51. The first control bar 511 is rotatably received in the first trough 2112, and the first outer and first inner axle seats 2113 and 2114 support to the first control bar 511. The first control bar 511 includes a first pin hole 5111 disposed at an end thereof and a first flange 5112. The first control bar 511 enters into the first case 214 via the first cavity 2143 and is connected with the worm shaft 35. The first expansion bar 512 is connected with and slidable with respect to the first control bar 511, and includes a first siding trench 5121 disposed corresponding to the first pin hole 5111. A first pin 5122 passes the first siding trench 5121 and connects with the first pin hole 5111. The first flange 5112 is able to block the first expansion bar 512. An end of the first lid 513 is mounted on the first expansion bar 512, and another end of the first lid 513 is pivotally connected with the first shank 514.

The structure of the second leg 22 similar to the first leg 21 approximately includes a second upper hodler 221, a second lower holder 222, a second box 223, a second case 224, and a second inner tube 225. The second upper holder 221 is connected with the desk board 10 and includes a second trough 2211, second outer and second inner axle seats 2212 and 2213, a second slot 2214, and two second guide posts 2215. The second trough 2211 is extended from the front end 101 to the rear end 102 of the desk board 10. The second outer and second inner axle seats 2212 and 2213 are mounted on a bottom of the second trough 2211 to provide supporting the control unit 50. The two second guide posts 2215 are extended longitudinally towards the second lower holder 222. The second lower holder 222 includes two second outer tubes 2221, a second side cover 2222, a second through hole 2223, and a second supporting portion 2224. The two second outer tubes 2221 are slidably and movably connected with the two second guide posts 2215, respectively. The second side cover 2222 connects between the two second outer tubes 2221. The second through hole 2223 is disposed parallel to the second side cover 2222 longitudinally and vertical to the second supporting portion 2224. The second supporting portion 2224 provides the adjustable desk securely standing on the ground. The second box 223 is mounted between the second upper and second lower holders 221 and 222 and includes a second receiving portion 2231, a second bore 2232, two second guide grooves 2233, and a second aperture 2234. The second receiving portion 2231, the second bore 2232, and the second aperture 2234 connect and communicate with each other. The two second guide grooves 2233 respectively receive the two second guide posts 2215. The second case 224 is mounted on the second box 223 and protrudes out the second trough 2211 via the second slot 2214. The second case 224 is hollow inside and includes a second channel 2241, a second orifice 2242, and a second cavity 2243, which connect and communicate with each other. The second orifice 2242 is extended parallel to the second aperture 2234 and vertical to the second bore 2232. The second inner tube 225 is mounted on the second box 223 and received in the second through hole 2223, so that the second box 223 is capable of moving slidably with respect to the second lower holder 222.

The second adjusting unit 40 includes two supporting pipes 41, two sleeves 42, first and second screw bars 43 and 44, first, second, third gear assemblies 45, 46, and 47, and a linking rod 48. The two supporting pipes 41 are respectively disposed in the first and second inner tubes 215 and 225. The two sleeves 42 are respectively mounted on an end of the two supporting pipes 41, and each sleeve 42 includes a screw hole 421, and a convex 422 blocked on the supporting pipes 41 to locate the sleeve 42 on the supporting pipes 41. The first screw bar 43 is movably extended in the supporting pipes 41 disposed in the second inner tube 225. The first screw bar 43 has a screw portion 431 engaged with the screw hole 421 of the sleeve 42. An end of the first screw bar 43 passes through the second aperture 2234 of the second box 223 and the second orifice 2242 of the second case 224 and is connected with the first and second gear assemblies 45 and 46. The second screw bar 44 is movably extended in the supporting pipes 41 disposed in the first inner tube 215. The second screw bar 44 has a screw portion 441 engaged with the screw hole 421 of the sleeve 42. An end of the second screw bar 44 passes through the first aperture 2134 of the first box 213 and is connected with the third gear assembly 47. The first gear assembly 45 is received in the second channel 2241 and includes two first bevel gears 451 respectively connected with the first screw bar 43 and second control assembly 52 and the two first bevel gears 451 engage with each other. The second gear assembly 46 is received in the second receiving portion 2231 and includes two second bevel gears 461 respectively connected with the first screw bar 43 and the linking rod 48 and the two second bevel gears 461 engage with each other. The third gear assembly 47 is received in the first receiving portion 2131 and includes two third bevel gears 471 respectively connected with the second screw bar 44 and the linking rod 48 and the two third bevel gears 471 engage with each other. The linking rod 48 is received in the pore 231 of the beam 23. An end of the linking rod 48 passes through the second bore 2232 of the second leg 22 and connects with the second gear assembly 46; another end of the linking rod 48 passes through the first bore 2132 of the first leg 21 and connects with the third gear assembly 47.

The second control assembly 52 includes a second control bar 521, a second expansion bar 522, a second lid 523, and a second shank 524. The second control bar 521 is rotatably received in the second trough 2211, and the second outer and second inner axle seats 2212 and 2213 support to the second control bar 521. The second control bar 521 includes a second pin hole 5211 disposed at an end thereof and a second flange 5212. The second control bar 521 enters into the second case 224 and is connected with one of the two first bevel gears 451 disposed parallel to the second control bar 521. The second expansion bar 522 is connected with and slidable with respect to the second control bar 521, and includes a second siding trench 5221 disposed corresponding to the second pin hole 5211. A second pin 5222 passes the second siding trench 5221 and connects with the second pin hole 5211. The second flange 5212 is able to block the second expansion bar 522. An end of the second lid 523 is mounted on the second expansion bar 522, and another end of the second lid 523 is pivotally connected with the second shank 524.

Figure 9:
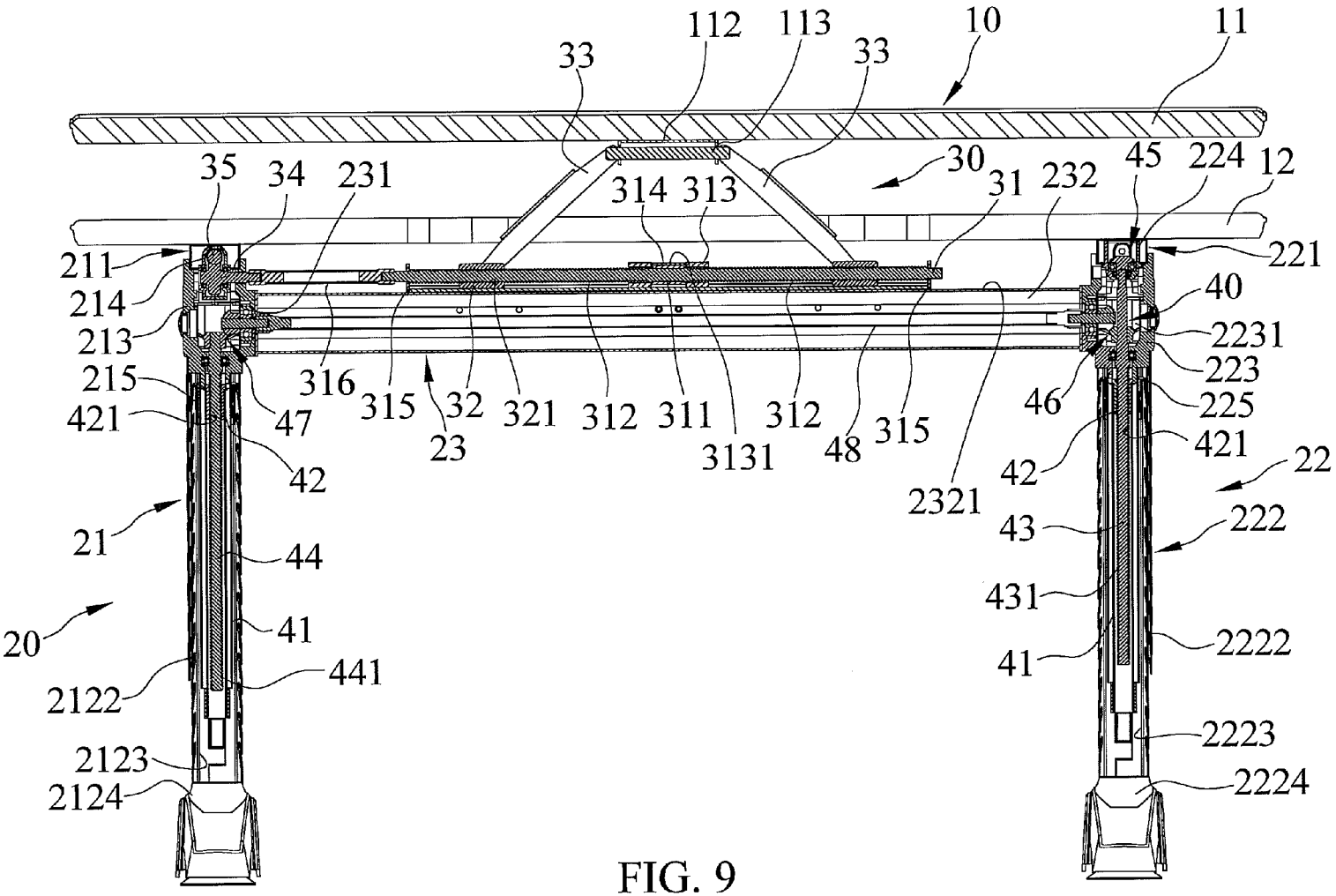
FIG. 9 is a continued cross-section view of FIG. 5 and shows a first adjusting unit actuating a desk board to slope.
Figure 10:
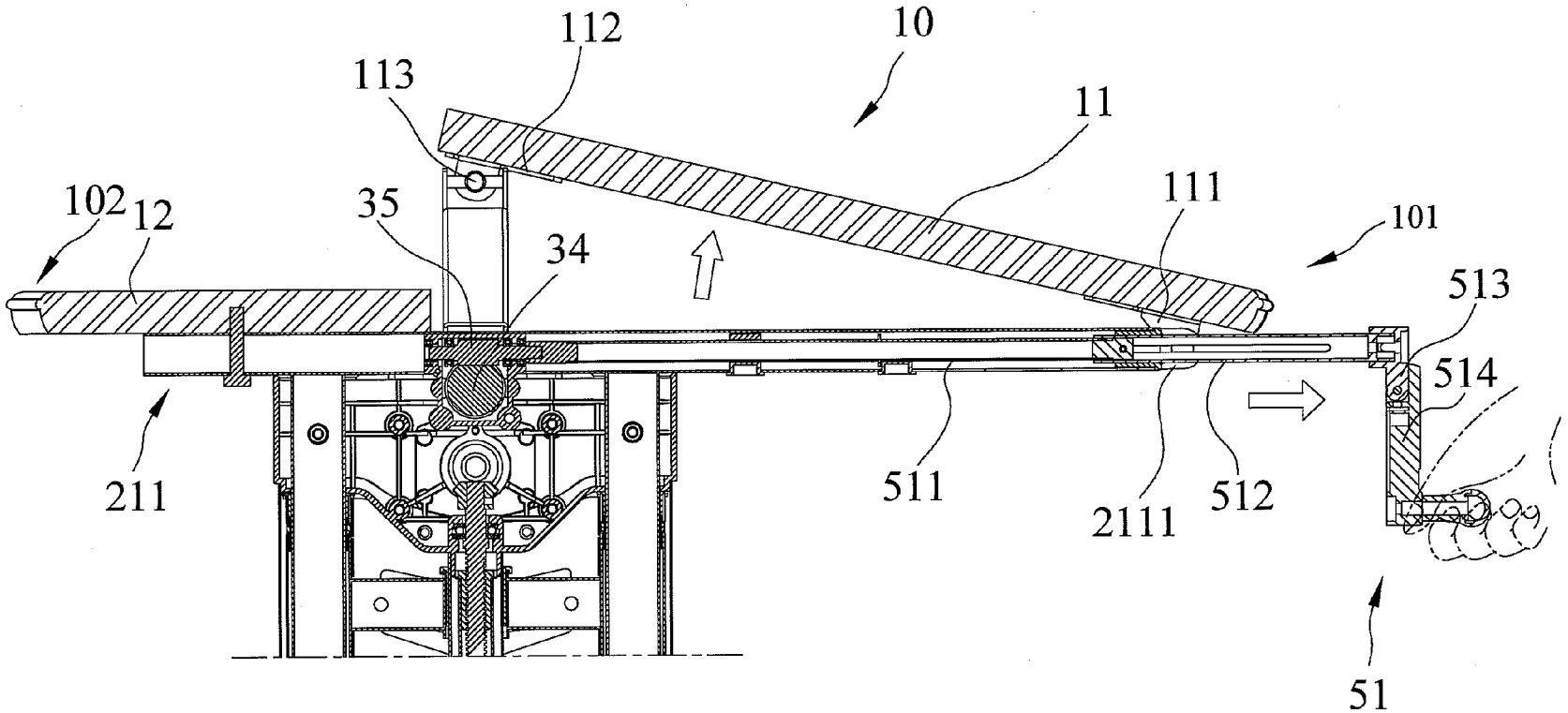
FIG. 10 is a partial, enlarged view of FIG. 7 and shows the first adjusting unit actuating a desk board.
Figure 11:
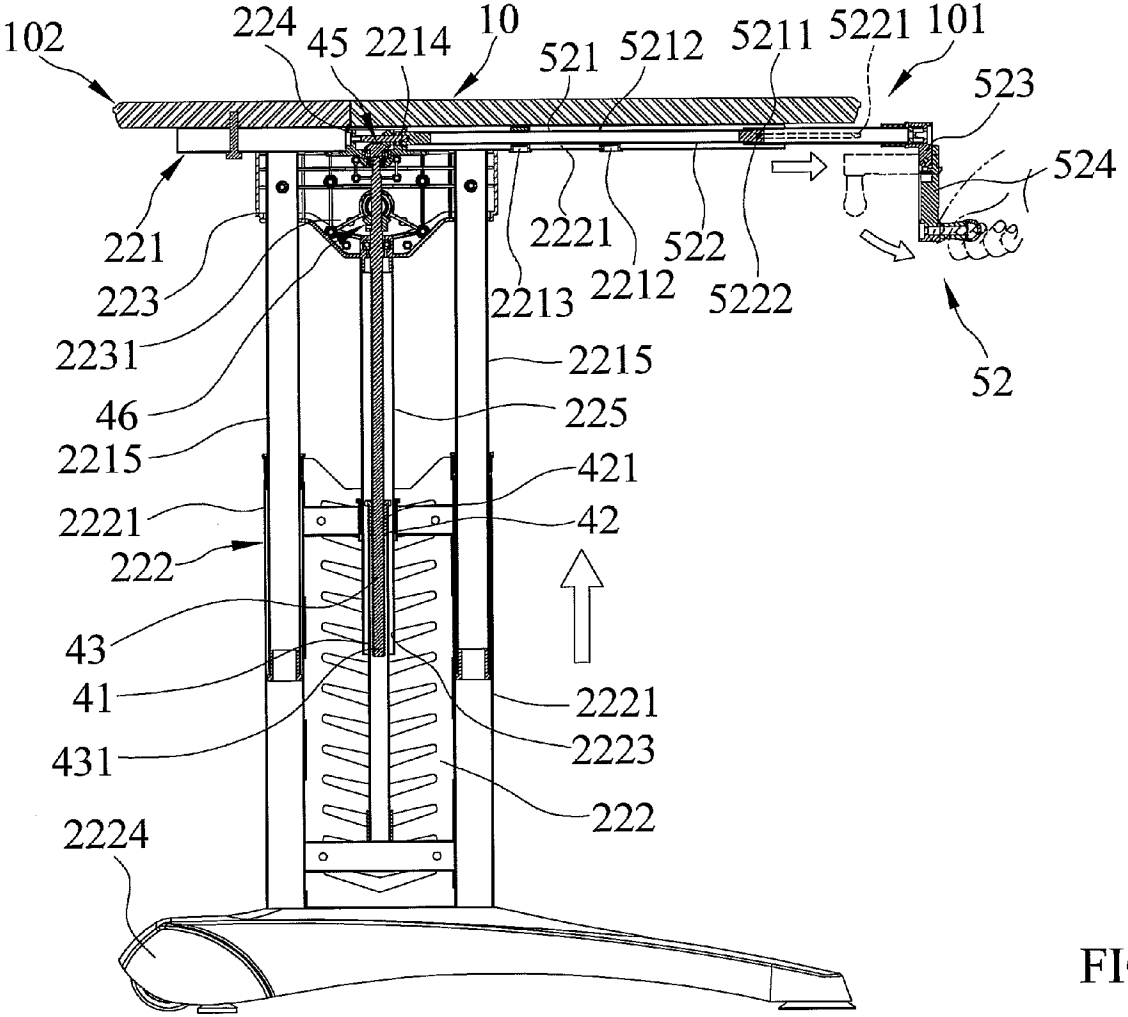
FIG. 11 is a continued cross-section view of FIG. 7 and shows a second adjusting unit actuating a supporting unit to rise.

Referring to FIGS. 9 through 11, a user can hold the first shank 514 and pull it towards a direction extending opposite to the front end 101, so that the first expansion bar 512 slides with respect to the first control bar 511, therefore the first shank 514 exposes out the front end 101. The user rotates the first shank 514 to drive the first expansion bar 512, the first control bar 511, and the worm shaft 35, and the worm shaft 35 drives the worm gear 34. The worm gear 34 drives the extending rod 316 and the screw shaft 31 to rotate, so that the two linkages 32 are respectively moved between the central portion 311 and the two braces 315 synchronously. Hence, the two linkages 32 respectively drive the two levels 33 pivoting with respect to the screw shaft 31. An included angle is defined between each linkage 32 and the screw shaft 31. The included angle formed when the linkage 32 is moved near the central portion 311 is larger than the included angle formed when the linkage 32 is moved near the brace 315. Hence, the included angle is adjustable by rotating the first shank 514 and the first rest 2111 is pivotally connected with the lug 111, so that a slope angle formed between the first panel 11 and the supporting unit 20 is adjustable steplessly without tools.

Additionally, the user can hold the second shank 524 and pull it towards a direction extending opposite to the front end 101, so that the second expansion bar 522 slides with respect to the second control bar 521, therefore the second shank 524 exposes out the front end 101. The user rotates the second shank 524 to drive the second expansion bar 522, the second control bar 521, the first gear assembly 45, and the first screw bar 43. Hence, the second box 223 is moved with respect to the second lower holder 222. The first screw bar 43 drives the second gear assembly 46, and the second gear assembly 46 drives the linking rod 48 to rotate with respect to the pore 231. The linking rod 48 drives the third gear assembly 47, so that the first box 213 is moved with respect to the first lower holder 212. Consequently, the first first upper holder 211 of the first leg 21 and the upper holder 221 of the second leg 22 are able to adjust steplessly with respect to the first lower holder 212 of the first leg 21 and the second lower holder 222 of the second leg 22, respectively, so that a height defined between the desk board 10 and the ground is adjustable.

While the specific embodiments have been illustrated and described, numerous modifications come to mind without significantly departing from the spirit of invention and the scope of invention is only limited by the scope of accompanying claims.

What is claimed is:

1. An adjustable desk comprising:

a desk board including front and rear ends;

a supporting unit disposed between the desk board and the ground, with the supporting unit including a first leg pivotally connected with the front end of the desk board, with the first leg including first upper and lower holders, and a first ease, with the first upper holder connected with the desk board, with the first upper holder including a first rest pivotally connected with a lug, a first trough extended from the front end to the rear end of the desk board, and a first slot; with the first lower bolder connected with the first upper holder and including a first supporting portion to provide the adjustable desk securely standing on the ground, with the first case mounted between the first upper and lower holders and protruding out the first trough via the first slot, with the first case being hollow inside and including a first channel, wherein the first case includes a first orifice and a first cavity connecting and communicate with each other, with the first orifice extended crossing with the first cavity; and a first adjusting unit mounted between the desk board and the first leg, with the first adjusting unit including a screw shaft, at least one linkage, at least one level, a worm gear, and a worm shaft, with the screw shaft including a central portion, at least one outer screw portion, and an extending rod, with the at least one outer screw portion including two outer screw portions respectively extended from two opposite ends of the central portion to the two distal ends of the screw shaft, with the linkage including an inner screw portion engaged with the at least one outer screw portion, with the level pivotally connected between the linkage and the rear end of the desk board, with the worm gear connected with the screw shaft, with two ends of the extending rod respectively connected with the screw shaft and the worm gear, with the worm gear and the worm shaft rotatably received in the first leg, with the worm gear and the worm shaft engaged with each other, with the worm shaft being rotatable to drive the worm gear rotated, with the worm gear rotated to drive the screw shaft rotated, with the worm gear and the shaft received in the first channel, with the worm gear protruding out the first case via the first orifice and connecting with the extending rod, with the worm shaft extending through the first cavity and engaging with the worm gear;

wherein the worm gear is able to drive the screw shaft, wherein while the screw shaft is rotated, the linkage is moved axially between two opposite ends of the at least one outer screw portion to drive the level pivoting with respect to the screw shaft, wherein the desk board is pivoted with respect to the first leg to adjust a slope angle formed between the desk board and the supporting unit steplessly without tools.

2. The adjustable desk as claimed in claim 1 wherein the desk board includes first and second panels, with the first panel including a lug disposed adjacent to the front end and a seat disposed adjacent to the rear end, with the seat mounted on a stern and the stem connected between two sides of the seat, with at least one end of the stem pivotally connected with the level, with the second panel connected with the supporting unit.

3. The adjustable desk as claimed in claim 2 wherein the first adjusting unit includes two linkages and two levels, with each linkage including an inner screw portion engaged with the at least one outer screw portion; wherein while the screw shaft is rotated, each linkage is moved axially between the two opposite ends of the at least one outer screw portion, with each level pivotally connected between the one linkage and the stem; wherein while each linkage is moved axially with respect to the at least one outer screw portion, wherein each linkage drives the level to pivot with respect to the stem, whereby a height defined between the desk board and the screw shaft is adjusted.

4. The adjustable desk as claimed in claim 2 wherein the lug is formed in an L shape, wherein the seat is formed in a U shape, wherein the stem is formed in an I shape.

5. The adjustable desk as claimed in claim 1 further comprising a control unit including a first control assembly mounted on the first leg, with the first control assembly including a first control bar, a first expansion bar, a first lid, and a first shank, with the first control bar rotatably received in the first trough, with first outer and inner axle seats mounted on a bottom of the first trough supporting the first control bar, with the first control bar including a first pin hole disposed at an end thereof and a first flange, with the first control bar entering into the first case via the first cavity and connected with the worm shaft, with the first expansion bar connected slidably with respect to the first control bar, with the first expansion bar including a first siding trench disposed corresponding to the first pin hole, with a first pin passing the first siding trench and connecting with the first pin hole, wherein the first flange is able to block the first expansion bar, with an end of the first lid mounted on the first expansion bar, with another end of the first lid pivotally connected with the first shank.

6. The adjustable desk as claimed in claim 5 wherein the first upper holder includes two first guide posts, with the first lower holder including two first outer tubes, a first side cover, and a first through hole, with the two first outer tubes slidably and movably connected with the two first guide posts, with the first side cover connecting between the two first outer tubes, with the first through hole disposed parallel to the first side cover and vertical to the first supporting portion.

7. The adjustable desk as claimed in claim 6 wherein the first leg includes a first box, and a first inner tube, with the first box mounted between the first upper and lower holders, Wherein the first box includes a first receiving portion, a first bore, two first guide grooves, and a first aperture, with the first receiving portion, the first bore, and the first aperture connecting and communicate with each other, with the two first guide grooves respectively receiving the two first guide posts, with the first inner tube mounted on the first box and received in the first through hole, with the first box capable of moving slidably with respect to the lower holder.

8. The adjustable desk as claimed in claim 7 wherein the supporting unit includes a second leg mounted on a bottom of the desk board, and a beam connecting between first and second legs, with the beam including a pore.

9. The adjustable desk as claimed in claim 8 wherein the second leg includes a second upper holder, a second lower holder, a second box, a second case, and a second inner tube.

10. The adjustable desk as claimed in claim 9 wherein second adjusting unit is mounted in the supporting unit for adjusting the height between the desk board and ground, wherein the second adjusting unit includes two supporting pipes, two sleeves, first and second screw bars, first, second, third gear assemblies, and a linking rod.

11. The adjustable desk as claimed in claim 10 wherein the two supporting pipes are respectively disposed in the first and second inner tubes, with the two sleeves respectively mounted on an end of the two supporting pipes, with each sleeve including a screw hole, with the first screw bar movably extended in the supporting pipes disposed in the second inner tubes, with the first screw bar having a screw portion engaged with the screw hole, with the first screw bar passing through the second box and the second case and connected with the first and second gear assemblies, with the second screw bar movably extended in the supporting pipes disposed in the first inner tube, with the second screw bar having a screw portion engaged with the screw hole of the sleeve, with the second screw bar passing through the first box and connected with the third gear assembly.

12. The adjustable desk as claimed in claim 11 wherein the first gear assembly is received in the second case and includes two first bevel gears respectively connected with the first screw bar and second control assembly, with the two first bevel gears engaged with each other, wherein the second gear assembly is received in the second box and includes two second bevel gears respectively connected with the first screw bar and the linking rod, with the two second bevel gears engaged with each other, wherein the third gear assembly is received in the first receiving portion and includes two third bevel gears respectively connected with the second screw bar and the linking rod, with the two third bevel gears engaged with each other.

13. The adjustable desk as claimed in claim 12 wherein the linking rod is received in the pore of the beam, with an end of the linking rod passing through the second box and connecting with the second gear assembly, with another end of the linking rod passing through the first bore and connecting with the third gear assembly.

14. The adjustable desk as claimed in claim 12 wherein the control unit includes a second control assembly mounted on the second leg, with the second control assembly including a second control bar, a second expansion bar, a second lid, and a second shank, with the second control bar rotatably received in the second upper holder, with the second control bar including a second pin hole disposed at an end thereof and a second flange, with the second control bar entering into the second case and connected with one of the two first bevel gears disposed parallel to the second control bar, with the second expansion bar connected with and slidable with respect to the second control bar, with the second expansion bar including a second siding trench disposed corresponding to the second pin hole, with a second pin passing the second siding trench and connecting with the second pin hole, Wherein the second flange is able to block the second expansion bar, with an end of the second lid mounted on the second expansion bar, with another end of the second lid pivotally connected with the second shank.

* * * * *